US005913756A

United States Patent [19]

Glaser

[11] Patent Number: 5,913,756

[45] Date of Patent: Jun. 22, 1999

[54] MUSCLE ENHANCEMENT EXERCISER

[76] Inventor: Roland Dieter Glaser, 607 S. Glenwood Place, Burbank, Calif. 91506

[21] Appl. No.: 08/684,684

[22] Filed: Jul. 19, 1996

Related U.S. Application Data

[63] Continuation-in-part of application No. 08/557,744, Nov. 13, 1995, abandoned.

[51] Int. Cl.[6] ..... A63B 21/02

[52] U.S. Cl. ..... 482/128; 482/126; 482/125

[58] Field of Search ..... 482/121, 122, 482/126, 128, 125

[56] References Cited

U.S. PATENT DOCUMENTS 1,023,756 4/1912 Pons ..... 482/128
2,106,994 2/1938 Chapman ..... 482/128

FOREIGN PATENT DOCUMENTS 1365888 9/1974 United Kingdom ..... 482/128

*Primary Examiner*—Lynne A. Reichard
*Attorney, Agent, or Firm*—Gene Scott; Patent Law & Venture GP.

[57] ABSTRACT

A muscle enhancement device having two elongated tubes telescopically engaged with one another so that a first of the tubes slides axially within a second of the tubes. A spring is positioned within the second tube so as to bias the first tube to normally extend outwardly away from the second tube. The first tube provides a horizontally oriented, curved contact force distribution means designed to be positioned in contact with a surface, such as the abdomen, and the second tube provides an elongate horizontally oriented handle designed to be grasped in the hand. Thus, to exercise a muscle group such as the abdominals, the user simply positions the curved force distribution means against that portion of the body and pulls the handle toward the body with enough force to compress the spring between the two tubes. A visual monitoring means allows the exerciser to see how far each cycle of exercise motion progresses so as to motivate and control the exercise in terms of difficulty and consistency.

6 Claims, 5 Drawing Sheets

MUSCLE ENHANCEMENT EXERCISER

BACKGROUND OF THE INVENTION

This application is a CIP of U.S. patent application Ser. No. 08/557,744 filed Nov. 13, 1995 now abandoned.

FIELD OF THE INVENTION

This invention relates generally to exercise and muscle building devices and equipment, and more particularly to an improved muscle enhancing device having an easily adjustable working tension so as to allow the device to be used by people of all fitness and strength levels.

DESCRIPTION OF RELATED ART

Invention and use of muscle enhancement devices are known to the public, as they are frequently used to strengthen muscles of the body. There are many enhancement devices that are designed particularly for strengthening the abdominal muscles. For example, Van Der Hoven U.S. Pat. No. 5,160,304 discloses a portable device having a push arm resiliently penetrating a transversal yoke. The distal end of the arm is placed against the abdomen while the user pulls the yoke towards the body by way of a pair of handles mounted astride the arm. The operator contracts the abdominal musculature while pulling the hands on a tensioned mechanism. Strengthening of the abdominal musculature is achieved by moving the abdomen against a resilient stop.

McLaughlin U.S. Pat. No. 4,775,148 discloses an abdominal exerciser for use with a belt that encircles the abdomen. A planar contacting plate rests on the abdomen and a retainer plate is spaced from the contacting plate so as to retain the belt in a relatively fixed position away from the skin of the abdomen. A coiled compression spring biases the retainer plate and belt away from the contacting plate. Exercise of the abdominal muscles is achieved by alternatively tightening the muscles to push the contracting plate toward the retainer plate and then relaxing the muscles allowing the spring to push the contacting plate away from the retainer plate.

Schmeiss U.S. Pat. No. 4,842,273 discloses a pair of axially telescoping members each having plural springs within the interior. The telescoping members are held together in coaxial alignment by a rod, and a spring loaded indexing mechanism about the rod allows racheting between preferential angular orientations of the first member relative to the second member. At these angular orientations various ones of the plural springs within the bore of each telescoping sleeve may be placed in coaxial position. By the number of springs which are selectively co-axially positioned the device accords a varying resistance to compression which is useful for exercising muscles.

Van Straaten U.S. Pat. No. 5,046,726 teaches an device having a tube with a spring inside, a plunger reciprocal in the tube, handles on the plunger and transverse supports extending from the bottom of the tube for comfortably resting against the thighs or in the lap of a user. Stomach muscles are exercised by grasping the handles with the transverse supports on the thighs and applying a pumping action to the plunger.

Lewkovich U.S. Pat. No. 5,050,875 discloses an abdominal exerciser having a relatively flat base member and a centrally contoured outer member with a sufficient recess to receive the bony protuberances of the user's spine on one method of operation and the fingertips of both hands in a second method of operation. The members are pivotally connected at one end and a V-shaped opening can be formed at the opposite end by disposing a pivotally moving spring between the members. Additionally, in one embodiment, a resistance measuring gauge can be attached to the base member and positioned through a hole in the centrally contoured outer member. The user directly exercises the abdominal muscles by forcing the members together against the resistance of the spring when the device is used either fixed between a stable surface and the low back, or fixed between the abdominal region and the grip of both hands.

Blowsky et al. U.S. Pat. No. 4,211,404 discloses a physical exercising device having a design which permits it to be manufactured in a small, compact configuration. The exercising device includes means for enabling increased compression of a compression spring located in the exercising device.

Speyer U.S. Pat. No. 3,228,392 teaches an abdominal exerciser with a dished plate which can be applied either directly to the body or covered by a resilient foam or foam rubber or foam plastic cover which can be removably attached to the dished plate to provide a flexible cushion between the rigid plate and the body of the user. The dished plate has attached a stem which fits slidably into an operating handle. The stem is surrounded by a coiled spring which is covered by a rubber hose acting as an additional spring.

However, many of these devices are rather large, bulky assemblies having many moving parts and a relatively complicated mode of operation. In addition, many of the prior art devices provide no means by which to adjust the workout tension of the device, thus requiring that new devices be purchased as the user's muscles become stronger. Still further, many of the prior art devices provide no means by which to visually monitor the performance of the exercise being performed. The present invention fulfills these needs and provides further related advantages as described in the following summary.

SUMMARY OF THE INVENTION

The present invention is an improved muscle enhancement exercising device designed to tone and enhance the abdominal muscles as well as other muscle groups of the body, such as in the areas of the arms, chest and lower back. The invention consists generally of two elongated tubes telescopically engaged with one another. A spring is positioned within a second one of the tubes so as to bias the first tube to extend outwardly away from the second tube. The first tube provides a horizontally oriented, curved plate designed to be positioned in contact with a surface, and the second tube provides an elongate horizontally oriented handle designed to be grasped by the hands. Thus, to exercise the abdominal muscles, the user simply positions the curved plate against the abdomen and pulls the handle toward the body with enough force to compress the spring between the two tubes. This action requires the abdominals to flex, thus toning and strengthening these muscles. The compact configuration of the device is such that the curved plate may be similarly positioned against a variety of different muscle groups, such as the biceps or thighs in order to enhance these muscles.

Thus it is a primary object of the present invention to provide a device that is light weight and has few moving parts, thus making the present invention significantly less expensive and easier to operate and maintain than similar prior art exercising devices.

In addition, the device includes a disk that is threaded into the second tube so as to further compress the spring, thus allowing the user to easily and quickly adjust the workout tension as needed. This allows the device to be readily adjusted to accommodate users of all fitness and strength levels. Thus it is an object of the present invention to provide a compression type workout device having adjustable tension.

Another object of the present invention is to provide a device as described with the further advantage of providing a means for monitoring the progress of each cycle of the workout. In free weight training as well as in the use of most weight training apparatus, it is possible to determine the exact extent of each workout repetition simply because the movement of the weight training device is clearly visible. However with prior art devices of similar type to the present invention it is impossible to determine the exact level of achievement of each repetition.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for muscle enhancement through exercise. In such drawings.

DETAILED DESCRIPTION OF THE PREFERRED EMBODIMENT

Figure 1A:
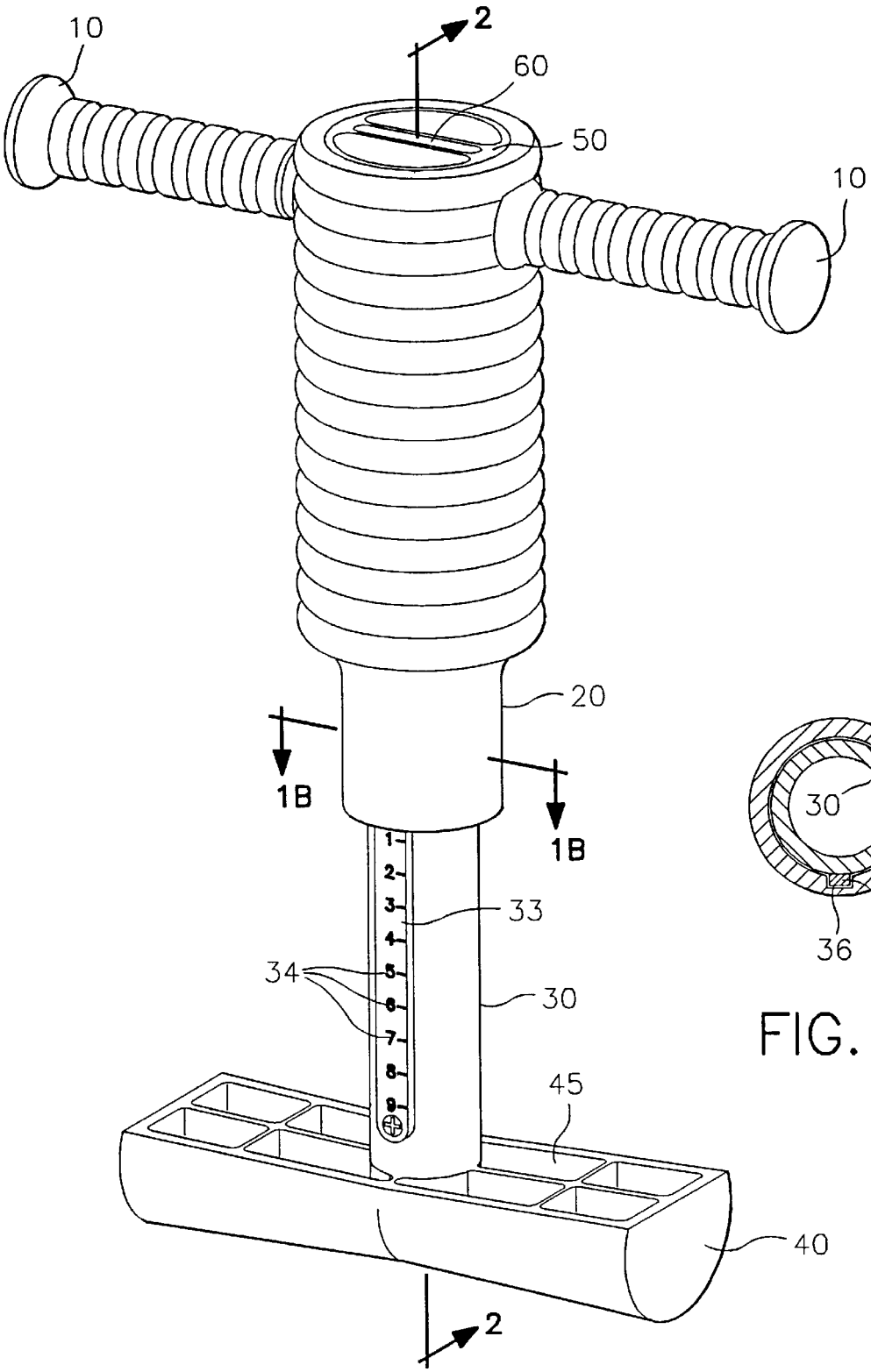
FIG. 1A is a perspective view of the preferred embodiment of the present invention device, particularly showing means for visually monitoring the motion extension of each repetition of an exercise.
Figure 1B:
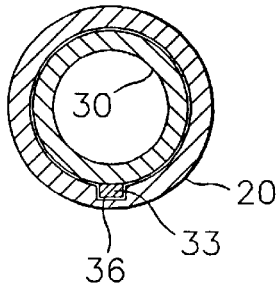
FIG. 1B is a cross-sectional view thereof taken along line 1B—1B of FIG. 1A, particularly showing a longitudinal keyway providing fixed alignment of the device.

The above described drawing figures illustrate a device for exercising various muscles of the body, particularly the abdominal muscles. The device has two vertically oriented (when used in a preferred manner) cylindrical tubes that are telescopically engaged with one another in such a way that a first 30 of the tubes slides axially within a second 20 of the tubes.

A free end of the first tube 30 provides a generally horizontally extending contact force distribution means 40. Preferably, as seen clearly in FIG. 1A, the force distribution means 40 provides a generally concave upward profile so that it may be easily and comfortably positioned against the contour of an abdomen (not shown). With this upwardly concave profile, the force distribution means, preferably a laterally extending bar, is better able to make contact with the abdomen so that contact force is not severe at any one point on the device abdomen interface. In order to decrease the weight and expense of the entire device, the force distribution means 40 is preferably hollow or contains a series of hollow cutout portions 45. The second tube 20 provides a horizontally extending grasping means 10 that extends laterally from the second tube 20 so as to be easily grasped by the hands of the user.

Figure 2A:
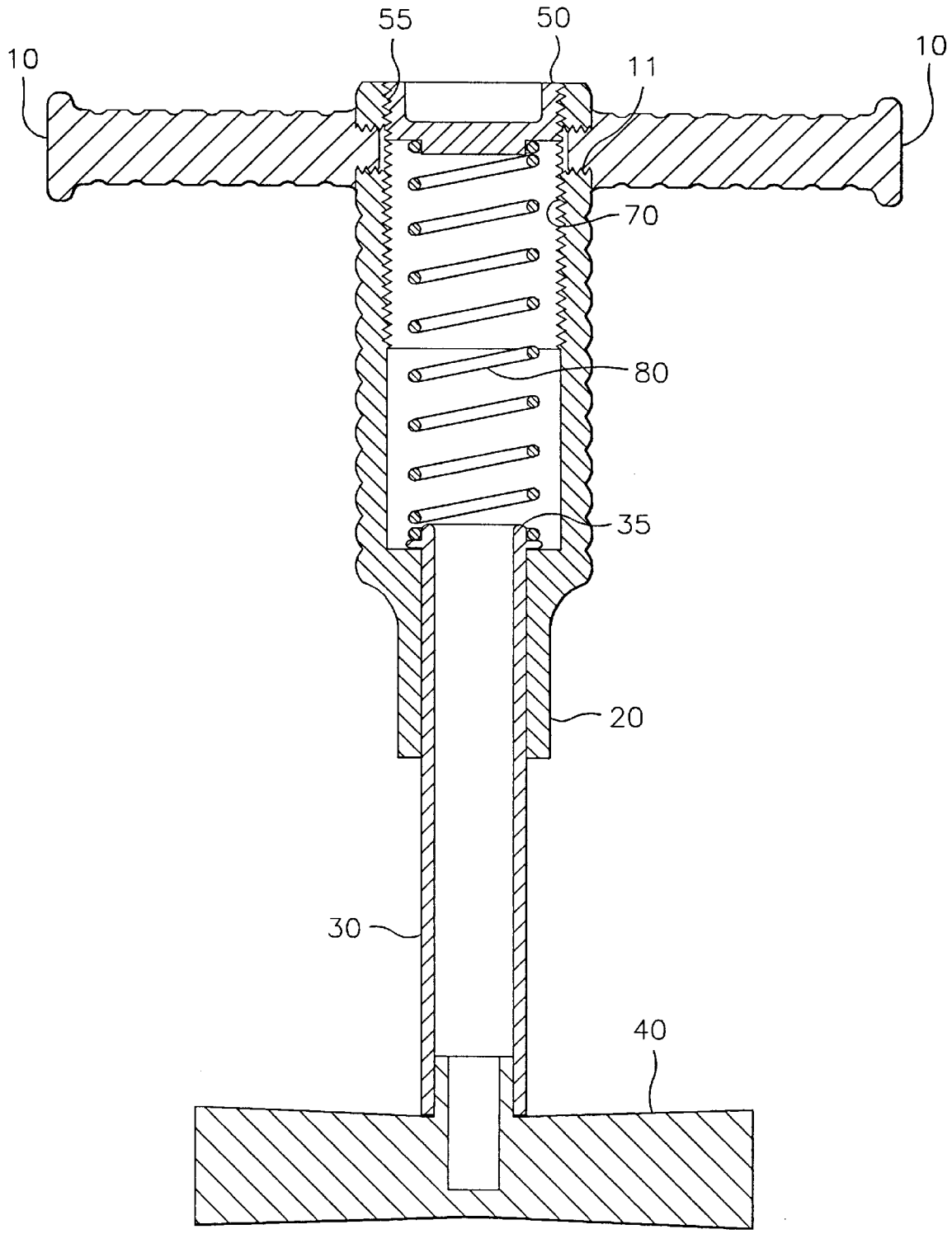
FIG. 2A is a cross-sectional view thereof taken along line 2—2 of FIG. 1A, particularly showing the device in a fully extended state.
Figure 2B:
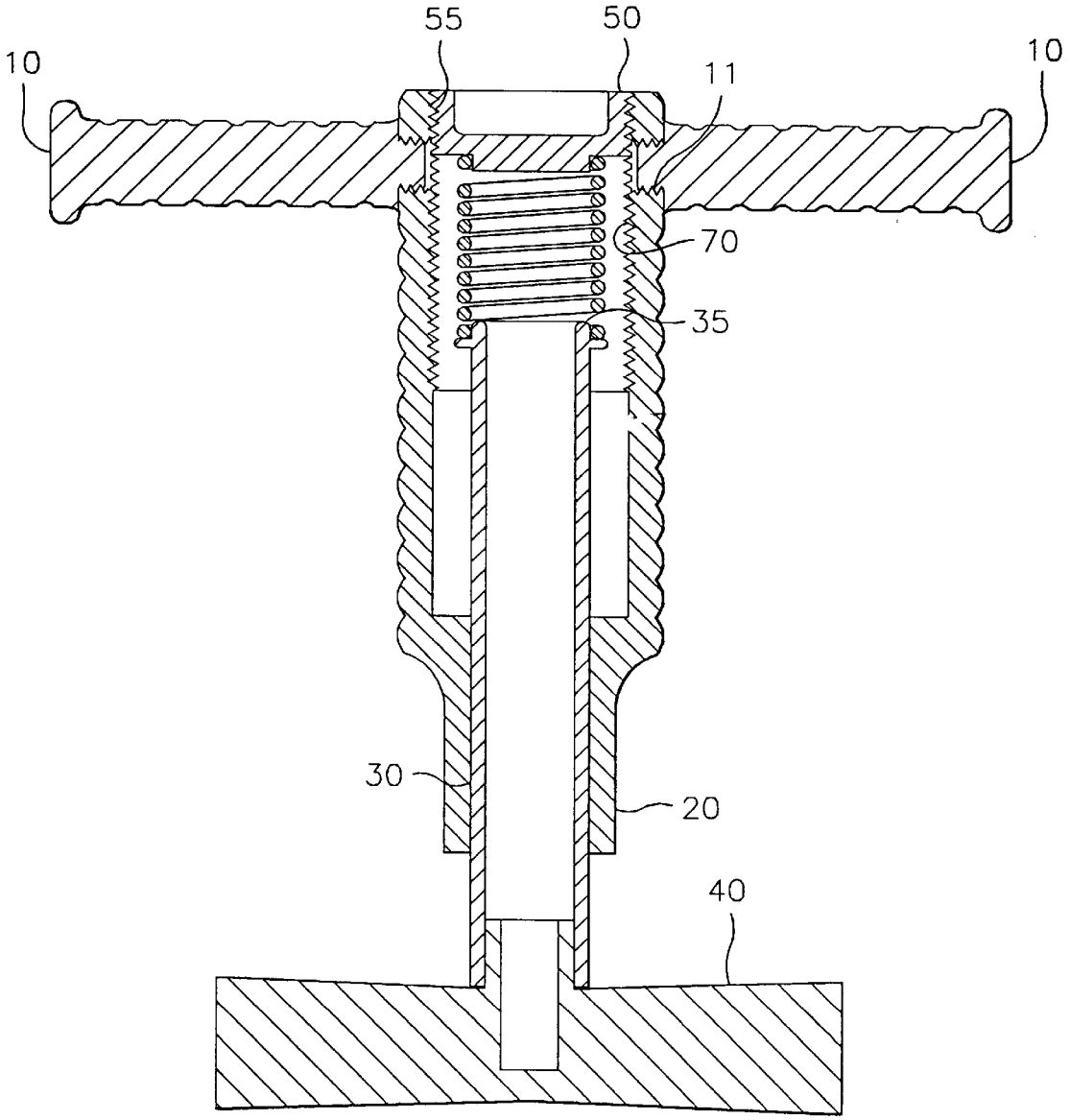
FIG. 2B is a cross-sectional view thereof taken along line 2—2 of FIG. A, particularly showing the device in a fully compressed state, FIGS. 2A and 2B, together, demonstrating the full range of motion of the device.
Figure 3:
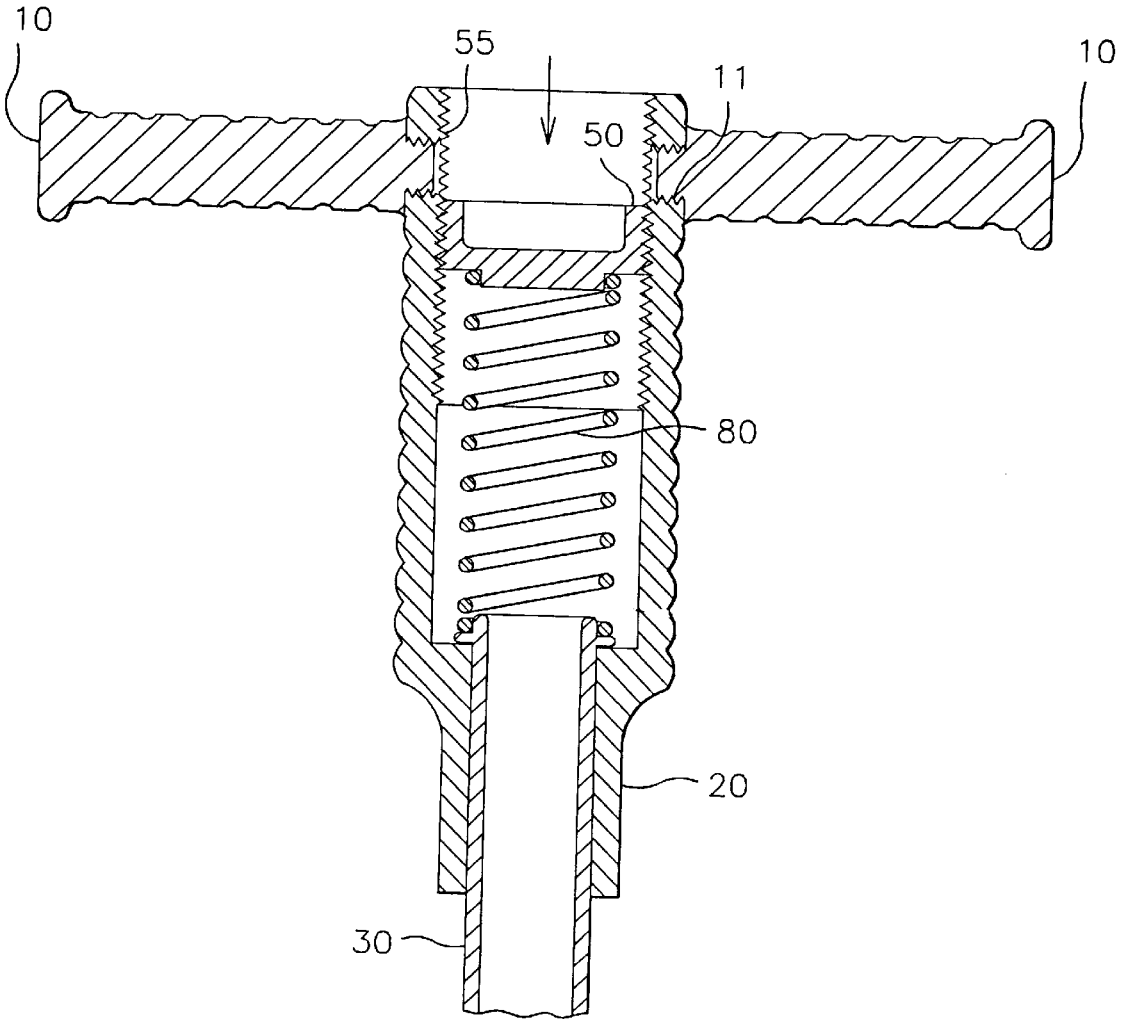
FIG. 3 is a partial cross-sectional view thereof taken along line 2—2 of FIG. 1A, particularly showing the means by which a biasing means is adjusted for a selected tension.

A biasing means 80, preferably a coil spring or the like, is positioned axially within the second tube 20 so as to bias the first tube 30 in an outwardly extended position relative to the second tube 20. The first tube 30 provides a stopping means 35 designed to stop the first tube 30 from being disengaged from the second tube 20. As illustrated in FIGS. 2 and 3, the stopping means 35, which preferably consists of a horizontal annular extending flange or the like, is engaged with the biasing means 80 also so that the biasing means is held centrally within the tube 20.

A bias force adjusting means 50 is also provided so as to allow a user to easily adjust the compression of the biasing means 80, and thus adjust the force necessary to push the first tube 30 inwardly into the second tube 20. The bias force adjustment means 50, preferably a threaded adjustment disk, operable within an internal screw thread 70 within the second tube 20 via a mating screw thread 55. The adjustment disk is shaped and sized so as to be easily positioned within the second tube 20 and threaded into a desired vertical position. In FIG. 2A, the adjustment disk is shown positioned in the end of the second tube 20, and in FIG. 3, it is shown threaded further into the second tube 20. As clearly illustrated, the further the disk is threaded into the second tube 20, the greater the pre-compression of the biasing means 80. This results in a workout that is more difficult in direct proportion to how far the disk is moved into tube 20. Preferably, a gripping means 60, such as an upwardly extending finger flange, is provided on the disk 50, thus making it easy to manually adjust the position of the disk.

Figure 4:
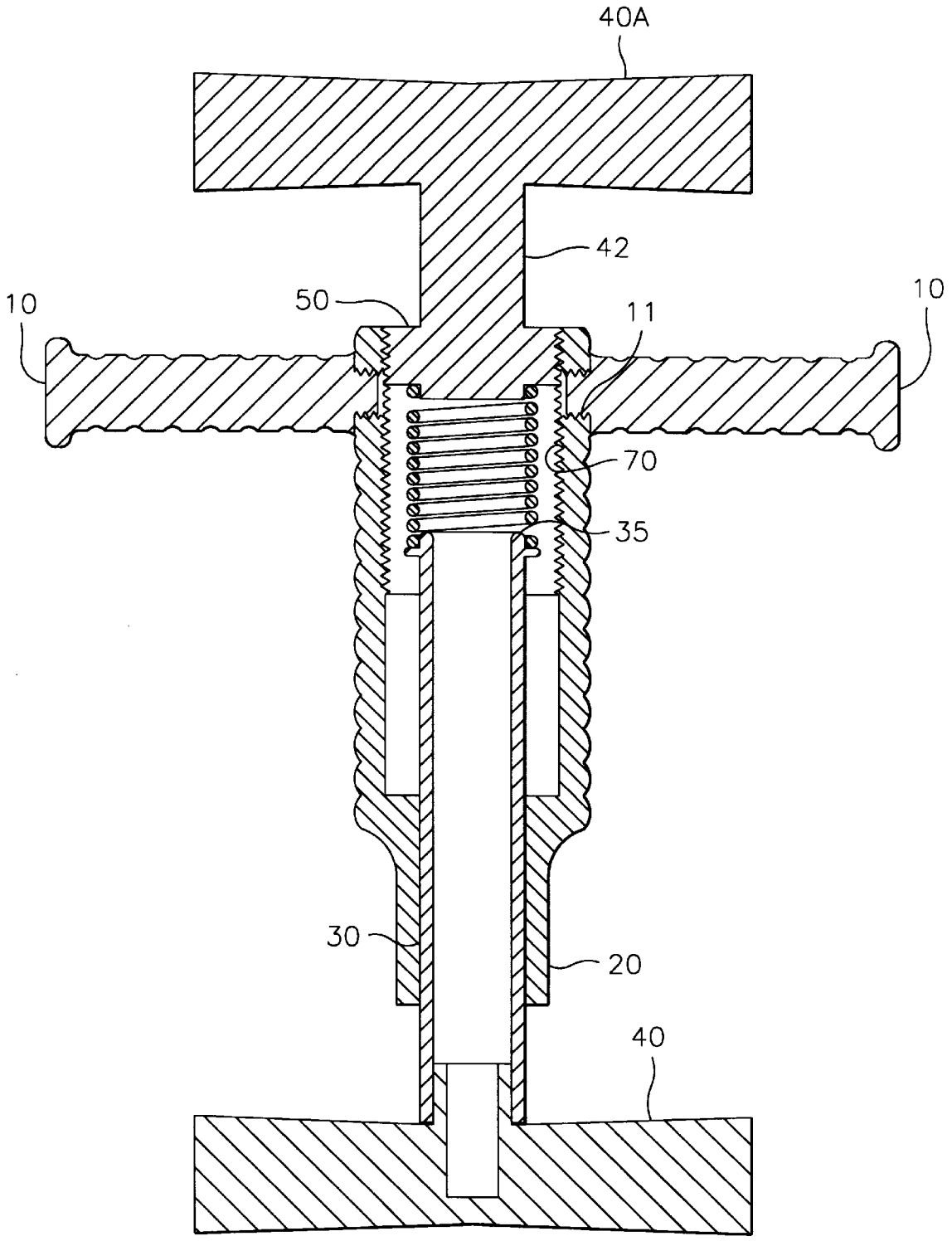
FIG. 4 is a cross-sectional view, similar to FIG. 2A, of an alternate embodiment of the present invention.

An alternate embodiment, as shown in FIG. 4, providing a second contact force distribution means 40A, is interconnected with the threaded adjustment disk 50 by an interconnection shaft 42 such that the second contact force distribution means 40 may be positioned in parallel with the grasping means 10 as well as the force distribution means 40. In this embodiment the exercising device may be used, not only for the stomach muscles, but for the arms, legs, back and neck. The two force distribution means 40 and 40A, may be positioned between the arms, between the legs, and between any part of the body and any surface, providing a convenient device for exercising almost any set of muscles.

A means for visually monitoring the position of the first tube 30 within the second tube 20 during exercising is integrally engaged with, or attached to the first tube 30. Preferably, the monitoring means consists of a graduated plate 33 that is longitudinally aligned with and affixed to the first tube 30, as seen in FIG. 1A. Printed indicia 34, such as numbers or letters, are preferably positioned on the plate 33 so as to most clearly indicate the position of the second tube 20 each time it is pulled downwardly over tube 30. The means for visually monitoring also preferably includes a longitudinal keyway 36 positioned in the second tube 20, the plate 33 on the first tube 30 slidably engaged within the keyway 36 of the second tube 20 so as to prevent the second tube 20 from rotating about the first tube 20.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An abdominal exerciser comprising:

a first and second cylindrical tubes, the tubes telescopically engaged such that the first of the tubes slides axially within the second of the tubes, a free end of the first of the tubes providing a means for contact force distribution, the second of the tubes providing a means for grasping, the distribution means and the grasping means, both extending laterally relative to the tubes;

a means for biasing the first of the tubes in an outwardly extended position relative to the second of the tubes;

a means for adjusting a bias force of the biasing means;

a means for visually monitoring the position of the first tube within the second tube, said monitoring means integrally engaged with the first of the tubes, and slidably engaged with the second of the tubes so as to prevent the second of the tubes from rotating about the first of the tubes;

the bias force adjustment means including an internal screw thread within the second of the tubes and an adjustment disk fitted to the internal screw thread so as to be threadably positionable within the second of the tubes for compressing the coil spring.

2. The exerciser of claim 1 wherein the force distribution means provides a generally concave upward profile.

3. The exerciser of claim 1 wherein the biasing means is a coil spring.

4. The exerciser of claim 3 wherein the first of the tubes provides a means for stopping the first of the tubes from being disengaged from the second of the tubes, said stopping means further engaging the coil spring.

5. The exerciser of claim 1 wherein monitoring means is a graduated plate longitudinally aligned with and fixed to the first of the tubes, the second of the tubes providing a longitudinal keyway engaged with the plate.

6. The exerciser of claim 1 further including a second contact force distribution means interconnected with the threaded adjustment disk by an interconnection shaft such that the second contact force distribution means may be positioned in parallel with the grasping means as well as the force distribution means.

* * * * *